US005383633A

United States Patent [19]

Ellestad

[11] Patent Number: 5,383,633

[45] Date of Patent: Jan. 24, 1995

[54] ILLUMINATING DEVICE FOR USE IN HAZARDOUS SITUATIONS

[76] Inventor: Michael J. Ellestad, 2430 Jefferson Point Dr., Apt. 935, Arlington, Tex. 76006

[21] Appl. No.: 242,701

[22] Filed: May 13, 1994

Related U.S. Application Data

[63] Continuation of Ser. No. 940,044, Sept. 3, 1992, abandoned.

[51] Int. Cl.[6] ..... F21V 33/00

[52] U.S. Cl. ..... 248/160; 362/103; 362/154; 239/270

[58] Field of Search ..... 248/160; 362/190, 191, 362/396, 103, 105, 108, 253, 154, 156; 239/270; 220/367

[56] References Cited

U.S. PATENT DOCUMENTS

| | | | |
|---|---|---|---|
| 2,300,915 | 11/1942 | Florence . | |
| 2,402,877 | 6/1946 | Dial . | |
| 2,610,262 | 9/1952 | Cunningham | 362/191 |
| 2,691,721 | 10/1954 | Bornhuetter . | |
| 3,307,026 | 2/1967 | Kramer . | |
| 3,783,604 | 1/1974 | Florent et al. | 362/191 |
| 3,917,940 | 11/1975 | Duddy . | |
| 4,128,862 | 12/1978 | Thompson | 362/396 |
| 4,220,304 | 9/1980 | Wong et al. . | |
| 4,232,357 | 11/1980 | Dietz . | |
| 4,443,831 | 4/1984 | Godfrey et al. | 362/191 |
| 4,459,645 | 7/1984 | Glatter | 362/191 |
| 4,506,317 | 3/1985 | Duddy . | |
| 5,101,333 | 3/1992 | Glassford | 362/396 |
| 5,103,384 | 4/1992 | Drohan | 362/191 |

*Primary Examiner*—Scott A. Smith
*Attorney, Agent, or Firm*—John L. Sigalos

[57] ABSTRACT

A device for use in hazardous situations comprising an adjustable mount for connecting a light to a self-contained breathing apparatus. The mount includes an elongated flex tube with an accessory mounting bracket attached to one end and a support mounting bracket attached to the other end. Between the flex tube and both the accessory mounting bracket and support mounting bracket there are interposed insulating washers to provide electrical isolation of the accessory mounting bracket and support mounting bracket from the elongated flex tube and from each other. To further insulate the adjustable mount, there is provided electrical insulation covering the flex tube.

20 Claims, 4 Drawing Sheets

ILLUMINATING DEVICE FOR USE IN HAZARDOUS SITUATIONS

This application is a continuation of application Ser. No. 07/940,044, filed Sep. 3, 1992, now abandoned.

This invention relates to apparatus for adjustably mounting a portable work accessory and more particularly to an adjustable mount especially adapted for use in hazardous locations.

BACKGROUND OF THE INVENTION

Numerous situations occur in which it is desirable to adjustably mount a work accessory. Thus, for example, there are many occasions when it is desirable to mount a portable light such as a flashlight or to provide for the temporary and adjustable positioning of working tools or other mechanical implements. In addition to the foregoing generalizations, there also are occasions when it is desirable to have access to or to be able to reposition work accessories in such a way as to leave both hands of an operator free to perform other manipulations.

One specific application in which it is especially important to provide for the adjustable positioning of a working accessory is that which is encountered by fire-fighting personnel whose facility of movement may be limited by necessary accessories such as smoke masks, air tanks, thermally insulated garments, and the like. In particular, occasions are often encountered in which a fire-fighter equipped with the foregoing accessories needs to momentarily adjust a lighting implement while still retaining freedom of hands for other purposes. Thus, often when entering a smoke filled and hazardous location such as a residence attic or the like, the fire-fighter must employ both hands to gain entry or make his way safely within the hazardous area while at the same time minimizing damage to the structure and maximizing personal safety. Oftentimes this requires the effective positioning of a light in a way that is independent of the movement of his head. Thus, a light attached to his helmet may be ineffective in providing illumination in the desired direction or location. Accordingly, there has risen a need for an effective apparatus for providing adjustable mounting of work accessories such as a portable illuminator or radio which is essentially independent of the positioning of the user's head and which, although momentarily manual positioning may be required, is thereafter essentially independent of and does not require continuous manipulation by the user's hands.

BRIEF SUMMARY OF THE INVENTION

In accordance with the present invention, adjustable positioning apparatus is provided for mounting either in cooperative combination with other auxiliary apparatus such as a compressed air tank e.g., self-contained breathing apparatus (S.C.B.A), and it may be mounted on or supported by the same harness used for attachment to the body of a wearer. Alternatively, it may be mounted on or with a separate independent harness which also is attachable to the body of the user.

The apparatus further includes provisions for rendering the same electrically insulating so as to be nonconductive of electrical potentials that might be encountered by the user, thereby obviating a potentially serious hazard.

In the preferred embodiment, the apparatus includes an L-shaped bottom bracket adapted for attachment to a portable supporting device such as the aforementioned S.C.B.A. pack frame or independant harness, an elongated spring steel flex tube having an insulated exterior casing covering its entirety and a spring loaded mounting bracket fastened to the upper extremity of the insulated spring steel flex tube. Additional features include the provision of insulating washers adjacent to both extremities of the insulated spring steel flex tube so as to contribute to the insulating characteristics thereof and thereby enhance its electrical insulating characteristics.

OBJECTS AND FEATURES OF THE INVENTION

It is one general object of the invention to improve adjustable mounts for portable accessories adapted for human transport.

It is another object of the invention to facilitate use of transportable accessories.

It is still another object of this invention to enhance utilization characteristics by requiring only momentary adjustment, thereby leaving both hands of the user mainly free for other activities.

It is yet one further object of the invention to improve safety of utilization of transportable accessories.

Accordingly, in accordance with one feature of the invention, a spring steel flex tube is interposed between a support bracket and an accessories mounting bracket, thereby providing for a wide range of adjustable positions for portable accessories attached thereto.

In accordance with another feature of the invention, in one embodiment, an insulating casing is disposed around the aforementioned flex tube, thereby rendering the adjustable mount less susceptible to the accidental conduction of unwanted electrical potentials.

In accordance with yet another feature of the invention, in another embodiment, the flex tube and brackets are coated with an insulating coating.

In accordance with still another feature of the invention, provision is made to isolate the aforementioned flex tube electrically from both the mounting bracket and the accessory attachment bracket, thereby further contributing to prevention of electrical conduction therethrough.

These and other objects and features of the invention will be apparent from the following detailed description by way of a preferred embodiment with reference to the drawing.

DESCRIPTION OF THE PREFERRED EMBODIMENT

Figure 1:
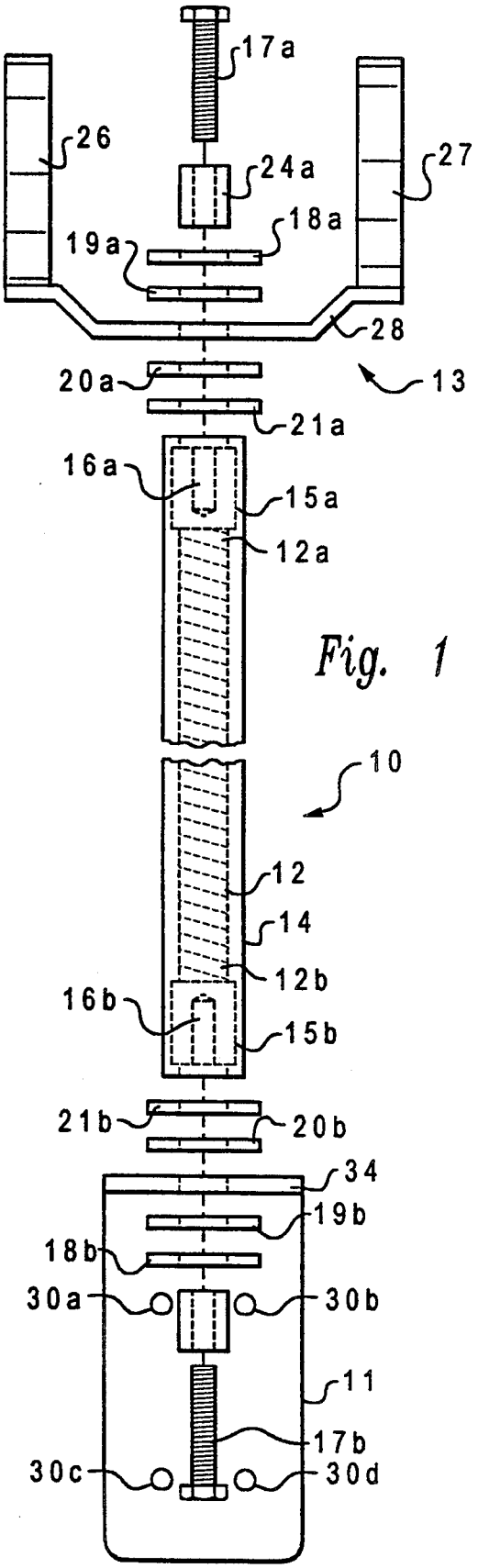
FIG. 1 is a partly exploded front view of the improved adjustable mounting device according to the invention.

Now turning to FIG. 1, a front elevation view of the improved adjustable mounting device 10 is shown. Such device comprises a lower attachment flange 11, an intermediate spring steel flex tube 12, and an upper portable device mounting bracket 13.

Fitted snugly around intermediate spring steel flex tube 12 is resilient insulating cover 14 which preferably is tubular in geometry and which, although snugly fitting around intermediate spring steel flex tube 12, is sufficiently pliable so as not to significantly impede the movement thereof.

As will be evident to those skilled in the art, resilient insulating cover 14 may be formed of any of a variety of suitable insulating materials well known in the art. Examples are insulating rubber, neoprene, and the like.

In addition to the foregoing characteristics, in the preferred embodiment the material of the resilient insulating cover is relatively scuff, abrasion, and puncture proof, thereby rendering the cover less vulnerable to damage in the event of contact with other objects.

Affixed to the upper and lower extremities **12*a* and 12*b* are threaded coupling sleeves 15*a* and 15*b*. These are rigidly affixed to upper and lower extremities 12*a* and 12*b*** respectively as shown in the figure.

Upper threaded coupling sleeve **15*a* is seen to include threaded female recess 16*a* which is adapted to receive the threaded portion of conventional hex head bolt 17*a*. Likewise, threaded female recess 16*b* is adapted to receive the threaded portion of conventional hex head bolt 17*b*. Hex head bolt 17*b* whether steel or plastic, is adapted to break away from lower attachment flange 11** in the event the adjustable mounting device should become entangled in debris or wires.

It is important that lower attachment flange 11 be electrically insulated from upper portable device mounting bracket 13. As mentioned above, there are times when persons such as fire-fighters enter hazardous areas, particularly those in which visibility is limited by smoke or other substances, that the wearer may accidentally contact electrical wiring still energized with dangerous electrical potentials. This is particularly concerning when the wearer is required to bend over or crawl through confined spaces and when electrical wiring may have fallen from a normal overhead position or be hanging down due to the action of intense heat. Accordingly, provision is made at both the upper and lower ends of the improved adjustable mounting device to insulate the extremities from each other. This is preferably accomplished through the utilization of a combination of nonconductive as well as conductive materials for bolts, sleeves, washers, and threaded coupling sleeves as will now be described.

In order to provide insulation and enhanced structural strength, four washers are provided at the upper extremity of the adjustable mounting device and four similar washers at the lower extremity. These, respectively, are identified as **18*a*–18*b*, 19*a*–19*b*, 20*a*–20*b*, and 21*a*–21*b*. Preferably, in the preferred embodiment, these washers are of conventional donut shape, washers 18*a*–18*b* and 21*a*–21*b* being of metal such as steel, and washers 19*a*–19*b* and 20*a*–20*b*** being of insulating materials such as teflon.

If hex head bolts **17*a* and 17*b* are made of electrically conductive material such as would be the case in the event that conventional steel bolts are used, then in order to prevent undesirable electrical conduction, insulating sleeves 24*a* and 24*b* are provided so as to prevent electrical contact between the bolts and metallic washers 18*a*–18*b* and 21*a*–21*b*. In addition, sleeves 24*a* and 24*b* additionally prevent electrical conduction between bolts 17*a*–17*b* mounting bracket 13 and attachment flange 11. Thus, electrical separation of mounting bracket 13 and attachment flange 11** is maintained, thereby retaining the electrical isolation characteristics desired for the improved adjustable mounting device.

It will be evident to those skilled in the art that if bolt **17*a* and 17*b* were fabricated of insulating material such as nylon, it would be possible to retain the above described electrical isolation without the necessity for including insulating sleeves 24*a* and 24*b*. In addition, it will be evident that if the upper and lower threaded coupling sleeves 15*a* and 15*b*** were made of suitable insulating materials, electrical isolation of the upper and lower extremities could be achieved thereby without the need for including insulating washers, sleeves, and the like. However, in order to retain the attractive qualities of strength and impact resistance, the preferred embodiment hereof includes the use of insulating washers and sleeves to achieve electrical isolation.

In addition to the foregoing, the preferred embodiment includes in its upper portable device mounting bracket 13, a pair of spring steel clips 26 and 27 (FIGS. 1 and 2) which are affixed through interconnecting portion 28. Affixation may be achieved by any of a variety of known ways such as welding, brazing, bolting or the like; or alternatively members 26, 27, and 28 may be stamped or otherwise fabricate as one unitary member.

In order to provide for attachment of flange 11 to a S.C.B.A. backpack frame, harness or the like, four circular apertures (bolt holes) **30*a*–30*d* are provided. However, it will be evident that other conventional means for attachment could be employed such as constructing a S.C.B.A. backpack and adjustable mounting device as one complete unit. Obvious modifications of bracket 11 may be needed to accommodate various backpacks, two representative brackets being shown in FIGS. 1 and 7**.

Turning again to FIG. 2, it will evident that it is a side elevation view of the adjustable mounting device 10 depicted in FIG. 1. However, in order to show spring steel flex tube 12 more clearly, the resilient insulating cover 14 is omitted.

Figure 4:
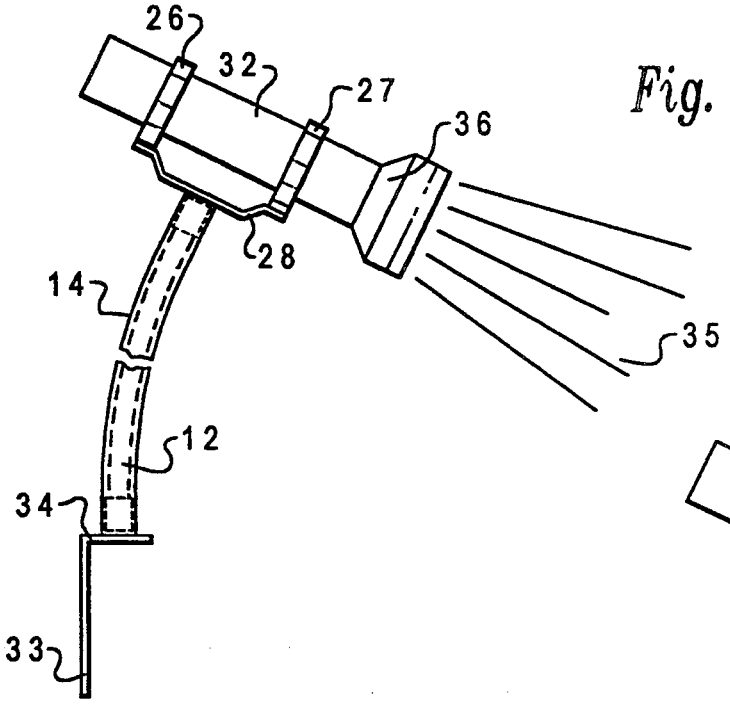
FIG. 4 is a simplified view depicting the improved adjustable mounting device with a flashlight positioned in the accessory mounting bracket.

The preferred geometrical shape of spring steel clip 26 is clearly observed and includes curved portions **31*a* and 31*b* which in the preferred embodiment are shaped so as to receive a cylindrically shaped object such as flashlight barrel 32 (FIG. 4**).

Figure 2:
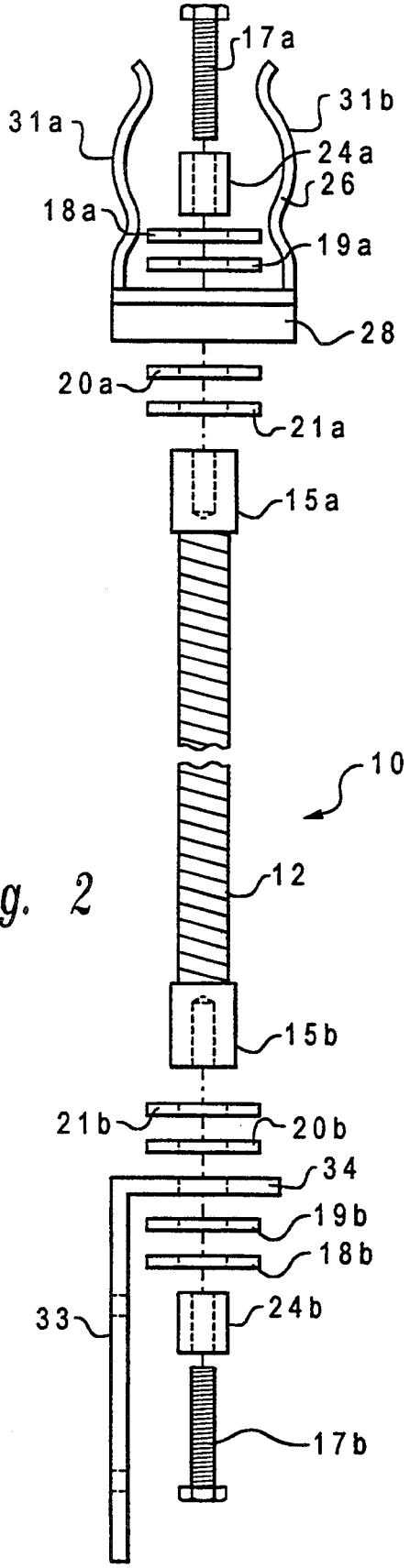
FIG. 2 is a side view of the improved adjustable mounting device of FIG. 1.

In the lower portion of FIG. 2, the L-shape bracket geometry which is the preferred shape for lower attachment flange 11, is clearly observed. It includes principal vertical portion 33, and an extended right angular horizontal projection 34.

Figure 3:
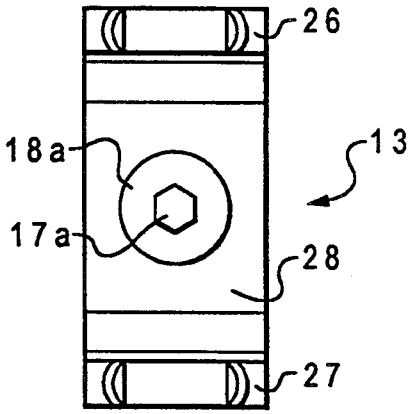
FIG. 3 is a top view depicting the attachment bracket for a portable accessory.

FIG. 3 depicts upper portable device mounting bracket 13 from above. There, it will be observed, are bolt 17*a*, washer 18*a*, interconnecting portion 28, and spring steel clips 26 and 27.

FIG. 4 illustrates the flexible nature of the spring steel flex tube 12 and resilient insulating cover 14. There, it will seen that the flex tube/cover has been bent forward so as to adjust the direction to which light 35 is projected from flashlight 36.

Figure 5:
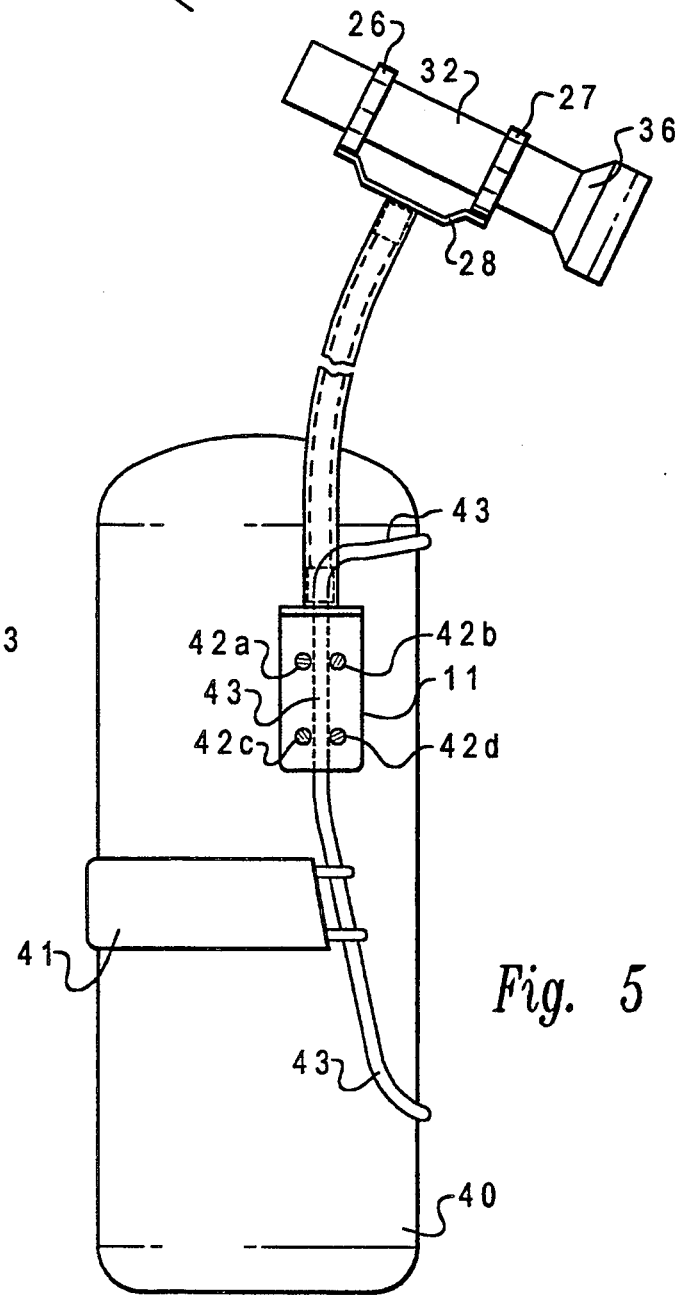
FIG. 5 is a view depicting a representative installation of the improved adjustable mounting device on a self contained breathing apparatus air tank.

FIG. 5 shows a self-contained breathing apparatus air tank 40, and illustrates the combination of the improved adjustable mounting device with portions 41 and 43 of a S.C.B.A. frame. Portions 41 and 43 are normally attached to a conventional harness (not shown) by which fire-fighters or other persons having occasion to utilize the tank would attach it to themselves. Also shown and illustrated as being affixed to the backpack frame is lower attachment flange 11 which may be fastened by the conventional bolts 42*a*–42*d* to portion 43 of the conventional S.C.B.A. backpack frame.

When attached to the person of one who anticipates entering a hazardous or other area requiring the use of self-contained breathing apparatus (which includes tank 40), it is conventional to utilize a backpack which positions the tank so that it moves in position relative to the environment along with the torso of the wearer. Accordingly, were it not for the flex/adjustable feature of the instant equipment, a light or other portable accessory attached to the tank would move correspondingly. However, the combination of the instant apparatus and the tank make it possible both to provide a stable support for a portable accessory such as a flashlight while at the same time providing for its adjustable positioning so as to direct the light in the desired direction or at a desired target independent of the position of one's head (as would be the case of a flashlight worn on a conventional head helmet) and without the necessity for utilization of one's hands other than momentarily when desired to make a position adjustment. Accordingly, it will be observed that in actual practice the combination of the tank (or other body supported support) with the improved adjustable mounting device provides a feature of adjustment which is substantially improved over that of the prior art.

As mentioned above, FIGS. 6–9 depict an alternate embodiment in accordance with the principles of the invention. There, it will be observed, is shown a spring clip 50 having sides 51 and 52 (FIG. 7) and a bottom portion 53. In contrast with the corresponding spring clip of FIGS. 1–5 which is comprised of portions 26, 27 and 28, spring clip 50 is seen to be a single unitary member.

Since it is desired in both of the embodiments of the invention to include the feature of electrical insulation, provision is made for interposing an insulating washer 54 between spring clip 50 and upper support bracket 55 which is preferably welded to upper coupling 56.

Although for clarity of presentation, upper support bracket 55 is shown as being separated from upper coupling 56, in practice the two will be fastened (e.g., welded) together at the lower surface of upper support bracket 55 and the upper surface of upper coupling 56.

Figure 6:
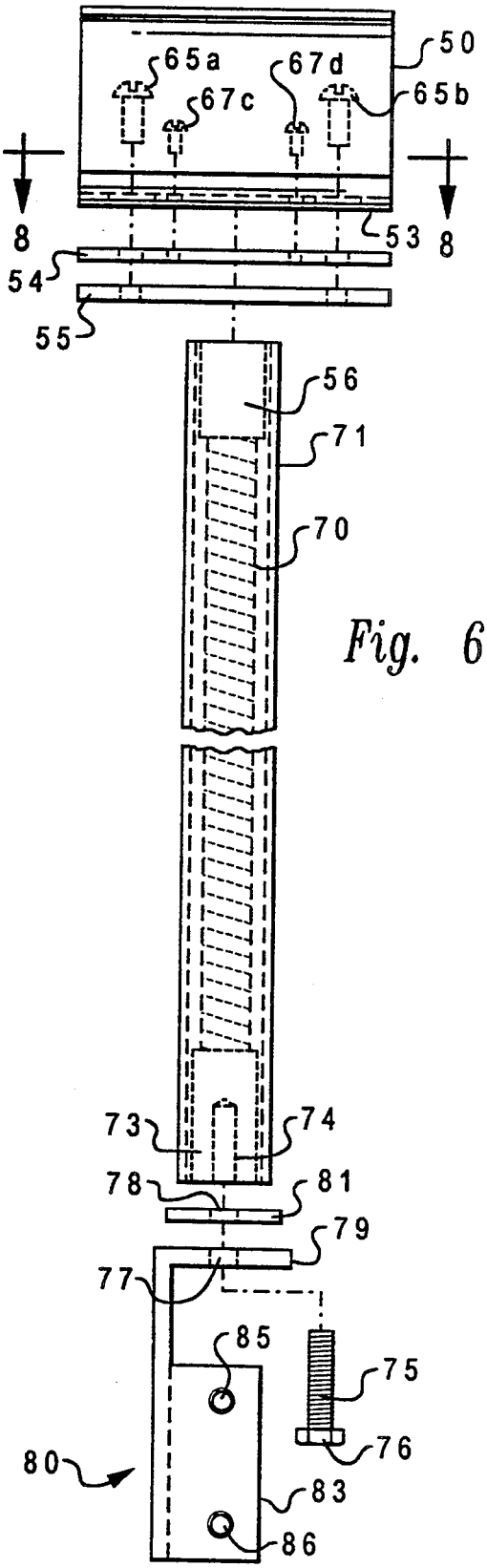
FIG. 6 is a side elevation view of an alternate embodiment in accordance with principles of the invention.
Figure 7:
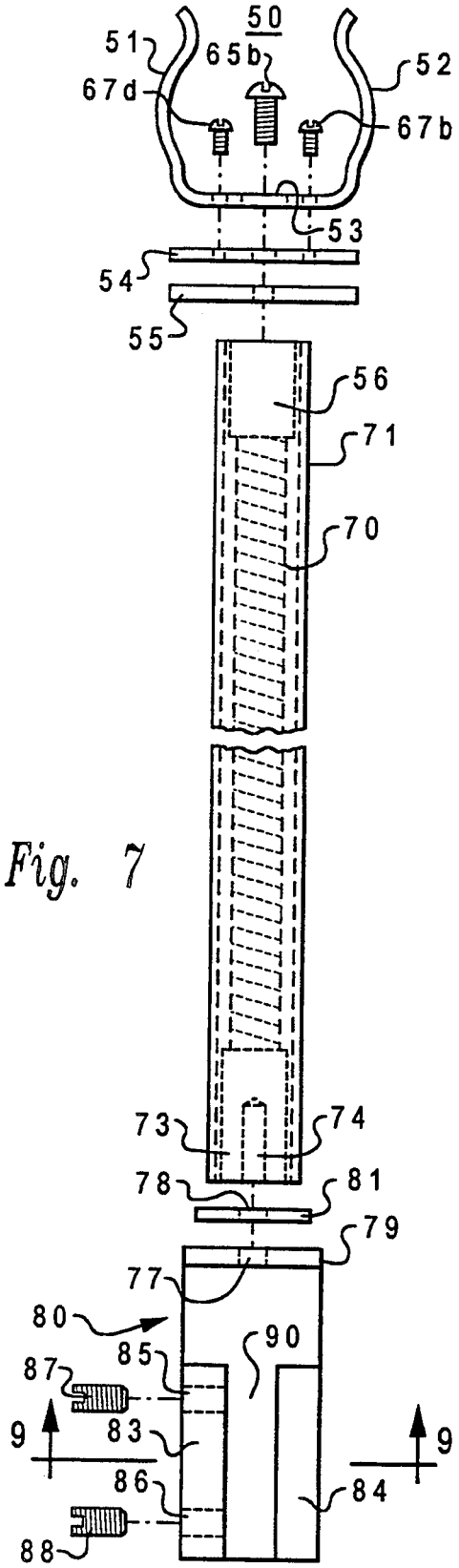
FIG. 7 is a rear elevation view of the alternate embodiment of FIG. 6.
Figure 8:
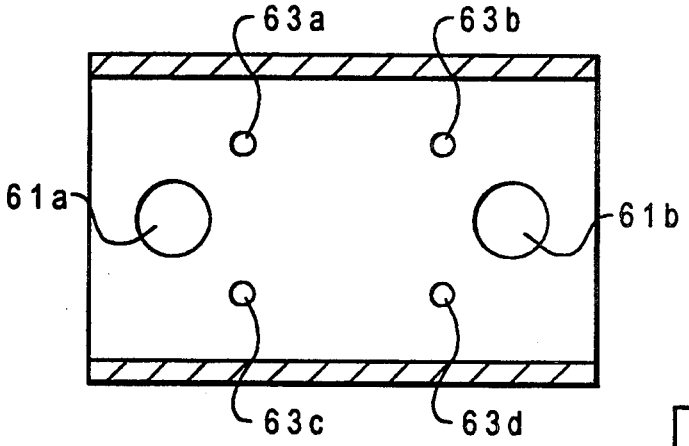
FIG. 8 is a sectional view through the lower part of the device mounting bracket of FIG. 7.
Figure 9:
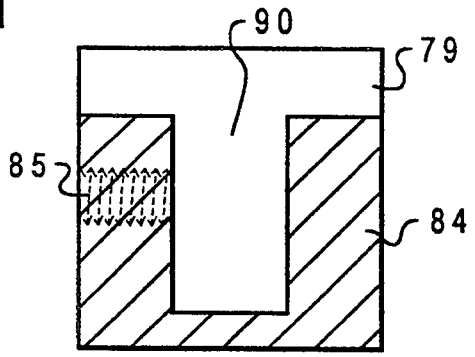
FIG. 9 is a sectional view through the attachment flange of FIG. 7.

The preferred mode for achieving a sturdy assembly of spring clip 50 through upper support bracket 55 while maintaining the insulating qualities of insulating washer 54 is illustrated in the sectional view depicted in FIG. 8. There, it will be observed, are a pair of large circular apertures 61*a* and 61*b* together with four much smaller apertures 63*a*–63*d*. These apertures are adapted to receive conventional mounting screws 65*a*–65*b* and 67*a*–67*d* (FIGS. 6 and 7). Screws 67*a*–67*d* fasten spring clip 50 to insulating washer 54 but do not pass through insulating washer 54. On the other hand, screws 65*a*–65*b* fasten insulating washer 54 to upper support bracket member 55, and apertures 61*a*–61*b* are sufficiently larger in diameter than the largest dimension of the heads of screws 65*a* and 65*b* so that there is no contact between screws 65*a*–65*b* and spring clip 50. Thus, by making the diameter of apertures 61*a*–61*b* substantially larger than the largest dimension of screws 65*a*–65*b*, substantial clearance therebetween is established so as to maintain the insulating integrity of insulating washer 54 and prevent electrical connection between spring clip 50 and upper support bracket member 55.

As mentioned above, it is contemplated that upper support bracket member 55 be welded or otherwise permanently fastened to upper coupling 56 thereby providing strength and durability. Upper coupling 56 is fastened to flex tube 70 in the same manner as coupling sleeve 15*a* is fastened to flex tube 12 of the embodiment of FIGS. 1–5. However, instead of utilizing a resilient insulating cover similar to cover 14 of FIGS. 1–5, the embodiment of FIGS. 6–9 contemplates the provision of an insulating deposited coating 71.

At the lower end of the adjustable mounting device of FIGS. 6–9, there is included lower coupling 73 which is seen to include threaded recess 74 that is adapted to receive the threaded portion of 75 of plastic bolt 76 (FIG. 6). Plastic bolt 76 may be made of any suitable insulating material such as teflon. It extends through unthreaded apertures 77 and 78 of flange portions 79 of bracket 80 and insulating washer 81. Thus, bracket 80 is electrically insulated from flex tube 70.

As a further feature and to provide additional insulating qualities, an insulating deposited coating is applied to spring clip 50 and also to bracket 80, thus contributing to the electrical insulation characteristics of the adjustable mounting device assembly.

Although any of a variety of known attachments may be provided to secure the device assembly to the aforementioned S.C.B.A. backpack, the embodiment of FIGS. 6–9 features a pair of extending wings 83 and 84 which may either be an integral part of bracket 80 or otherwise fastened thereto as by welding. Wing 83 is provided with a pair of apertures 85 and 86 which preferably are threaded so as to threadedly engage with set screws 87 and 88. Thus, provision is made for attaching bracket 80 to a portion of the S.C.B.A. harness (not shown in FIGS. 6–7) by fitting a portion the S.C.B.A. harness within slot 90 and then tightening set screws 87 and 88.

Figure 10:
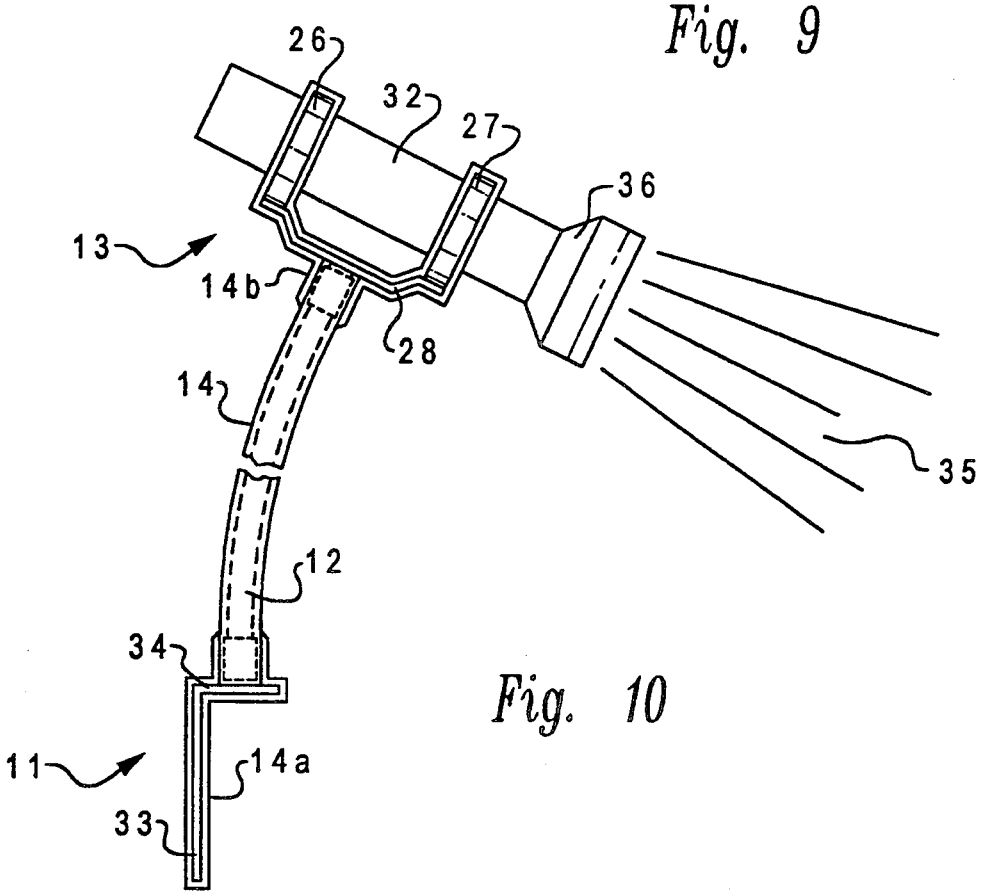
FIG. 10 is a simplified view similar to FIG. 4 but additionally including an extension of an insulated coating to cover the entire unit.

FIG. 10 depicts the improved adjustable mounting device of FIG. 4 with the insulated coating 14 extending to cover the support mounting bracket 11 and the accessory mounting bracket 13. FIG. 10 is seen to be identical to FIG. 4 except for the extension of the insulated coating 14 over mounting bracket 11 as identified by symbols 14*a* and extension of the coating 14 over accessory mounting bracket 13 as identified by symbols 14*b*. By extending such coating, additional insulating characteristic is imparted to the assembly, thus adding to its safety of use under hazardous conditions.

It will now be evident that there has been described herein a novel improved adjustable mounting device for portable accessories and the like which provides advantageous features over the prior art. Although the invention hereof has been described by way of an example of a preferred embodiment, it will be evident that other adaptations and modifications may be employed without departing from the spirit and scope thereof. For example, other types of flexible members could be employed provided that once positioned they retained the adjusted position until further adjustments were made. In addition, other types of portable accessories could advantageously be utilized as, for example, directional communication devices e.g., radio microphones. Fiber optics also may be used to direct illumination from an alternate light source.

The terms and expressions employed herein have been used as terms of description and not of limitation; and thus, there is no intent of excluding equivalents, but on the contrary, it is intended to cover any and all equivalents that may be employed without departing from the spirit and scope of the invention.

What is claimed is:

1. A device for use in hazardous situations comprising:

(a) an elongated flex tube having a first end and an opposite end, (b) an accessory mounting bracket attached to said first end, (c) a support mounting bracket attached to said opposite end, (d) insulating means interposed between said accessory mounting bracket and said elongated flex tube thereby to provide electrical insulation of said accessory mounting bracket from said elongated flex tube, a self-contained breathing apparatus connected to said support mounting bracket, and an illuminating means connected to said accessory mounting bracket.

2. The device according to claim 1 further including electrical insulating means interposed between said support mounting bracket and said elongated flex tube thereby to enhance electrical insulation of said accessory mounting bracket from said support mounting bracket.

3. The device according to claim 2 further including a flexible electrically insulating sleeve enclosing said elongated flex tube.

4. The device according to claim 3 in which said flexible electrically insulating sleeve is continuous to said elongated flex tube along the entire elongation of said elongated flex tube.

5. The device according to claim 4 in which said electrical insulating means interposed between said support mounting bracket and said elongated flex tube includes an insulating washer.

6. The device according to claim 2 further including an electrically insulating coating contiguously covering said elongated flex tube.

7. The device according to claim 2 in which said electrical insulating means interposed between said support mounting bracket and said elongated flex tube includes an insulating washer.

8. The device according to claim 2 in which said support mounting bracket includes a pair of wing-like extensions defining an elongated channel therebetween, one of said wing-like extensions including a pair of threaded apertures adapted for receiving fastening screws.

9. The device according to claim 1 further including an electrically insulating flexible sleeve enclosing said elongated flex tube.

10. The device according to claim 9 in which said electrically insulating flexible sleeve is continuous to said elongated flex tube along the entire elongation of said elongated flex tube.

11. The device according to claim 9 in which said electrical insulating means interposed between said accessory mounting bracket and said elongated flex tube includes an insulating washer.

12. The device according to claim 1 further including an electrically insulating coating contiguously covering said elongated flex tube.

13. The device according to claim 12 in which said insulating coating extends to cover said support mounting bracket and said accessory mounting bracket.

14. The device according to claim 12 in which said electrical insulating means interposed between said accessory mounting bracket and said elongated flex tube includes an insulating washer.

15. The device according to claim 1 in which said electrical insulating means interposed between said accessory mounting bracket and said elongated flex tube includes an insulating washer.

16. The device according to claim 1 in which said accessory mounting bracket comprises a pair of spring steel clips.

17. The device according to claim 1 in which said accessory mounting bracket comprises a single monolithic body.

18. The device according to claim 17 in which said single monolithic body includes a pair of sides and a bottom, wherein there are also included a first plurality of fastening screws of predetermined size and a second plurality of fastening screws of size larger than said screws of predetermined size, wherein within said bottom there are provided a plurality of apertures, a first predetermined number of said plurality of apertures being sized to closely fit the outside diameters of said first plurality of fastening screws and a second predetermined number of said plurality of apertures being sized to provide electrical separation between said second plurality of fastening screws and said accessory mounting bracket.

19. The device according to claim 1 in which said support mounting bracket is L-shaped.

20. The device according to claim 1 in which said support mounting bracket includes a pair of wing-like extensions defining an elongated channel therebetween, one of said wing-like extensions including a pair of threaded apertures adapted for receiving fastening screws.

* * * * *